US005280881A

United States Patent [19]

Karmin

[11] Patent Number: 5,280,881

[45] Date of Patent: Jan. 25, 1994

[54] HIGH SECURITY LOCKING DEVICE

[76] Inventor: Donald Karmin, 11A Marian St., Greenvale, N.Y. 11548

[21] Appl. No.: 952,953

[22] Filed: Sep. 29, 1992

[51] Int. Cl.[5] ..... E05B 47/00

[52] U.S. Cl. ..... 70/279; 70/275; 70/277; 70/280; 292/142; 292/144

[58] Field of Search ..... 70/275, 277-282; 292/142-144

[56] References Cited

U.S. PATENT DOCUMENTS

| | | | |
|---|---|---|---|
| 1,635,028 | 5/1926 | Burr et al. . | |
| 2,427,040 | 9/1947 | Billman | 70/280 x |
| 2,763,888 | 9/1956 | Billeter | 292/144 X |
| 3,548,619 | 12/1970 | Purdy | 70/279 X |
| 3,576,119 | 4/1971 | Harris | 70/271 |
| 3,933,382 | 1/1976 | Counts et al. | 70/280 X |
| 4,132,439 | 1/1979 | Millar | 70/279 X |
| 4,135,377 | 1/1979 | Kleefeldt et al. | 70/280 X |
| 4,277,094 | 7/1981 | Roue | 70/280 X |
| 4,372,419 | 2/1983 | Barnett et al. | 70/279 X |
| 4,633,688 | 1/1987 | Beudat et al. | 70/280 X |
| 4,691,948 | 9/1987 | Austin, Jr. et al. | 292/144 X |
| 4,702,095 | 10/1987 | Ben-Asher | 70/279 |
| 4,800,741 | 1/1989 | Kerschenbaum et al. | 70/279 X |
| 5,056,343 | 10/1991 | Kleefeldt et al. | 70/264 |

FOREIGN PATENT DOCUMENTS

| | | | |
|---|---|---|---|
| 2480841 | 10/1981 | France | 70/280 |

*Primary Examiner*—Peter M. Cuomo
*Assistant Examiner*—Suzanne L. Dino
*Attorney, Agent, or Firm*—Richard L. Strauss

[57] ABSTRACT

A high security locking device is disclosed especially adapted for use as a vehicle anti-theft and passenger security system. In one embodiment, the device comprises a frame, a bolt and a motor driven bolt actuator. The bolt resists slim-jim tampering and may be instantly locked and unlocked by means of a suitable switch. In a second embodiment of the present invention, a high security locking device is disclosed which comprises a frame; a coaxial slide bolt, having an inner core and an outer sheath, slideably positioned within the frame; a cylinder assembly positioned within the frame; an outer sheath positioning means coupled to and operated by said cylinder assembly; and a motor driven bolt actuator. The outer sheath is extended and withdrawn by means of the outer sheath positioning means controlled by a keyed cylinder mounted upon the outer surface of a door and optionally by means of a latch located within the vehicle. The inner core is operated by means of a motor driven bolt actuator.

15 Claims, 5 Drawing Sheets

HIGH SECURITY LOCKING DEVICE

TECHNICAL FIELD

The disclosed invention is related to the field of locks and locking devices. More specifically, the disclosed device is a locking device utilizing both motor driven and mechanical operation highly resistant to unauthorized operation.

BACKGROUND OF THE INVENTION

Despite the increased manufacture and sale of automotive security devices, automobile theft remains a major problem throughout the world. In recent years, assault of vehicle occupants has also become a common event. Despite the tremendous increase in the development and sales of anti-theft devices, professional thieves have no difficulty in breaking into vehicles and overriding existing devices. Automobile sirens announcing these burglaries attract little attention to a car thieve's efforts as these sounds have become as common a sound in urban areas as the sound of crickets in the countryside.

Once a thief has gained entrance to an automobile, he has little difficulty in distorting or cutting a steering wheel to remove a wheel lock or hot wiring an ignition system to defeat a starter or ignition kill alarm system. It is painfully obvious that access for over-riding these deterrent systems simply requires a thief to defeat the o.e.m. door locks baring his immediate entry into a vehicle. Unfortunately, the majority of o.e.m. locks may be opened, possibly faster than with a key, utilizing a "slim-jim" (a flat metal lock-tripping theft device). Therefore, the time a thief remains in view, and vulnerable to discovery, is minima.

The slim jim may also be utilized to allow entry through a locked car door for assault of individuals who erroneous believe they are safe within their cars. As discussed above, the slim jim allows a thief or assailant almost immediate entry into a locked vehicle. Therefore, an individual may be taken by surprise by a criminals entry into a vehicle while waiting at a traffic light or a highway entrance ramp.

What is needed is a device which effectively resists unauthorized entry into a locked vehicle. It would be highly desirable if such a device could be instantly operated from within a vehicle to provide added passenger security. It would be further desirable for such a device to additionally include a keyed mechanism for operation thereof from outside a vehicle.

SUMMARY OF THE INVENTION

Now in accordance with the present invention, a high security locking device is disclosed which effectively resists tampering and unauthorized operation by slim-jim devices. The locking device allows instant locking and unlocking operation by a vehicle occupant.

The high security locking device comprises a frame; a slide bolt slideably positioned within the frame; and a motor driven bolt actuator coupled to a first terminus of the bolt by a linkage means. A second terminus of the bolt is extended from the frame into a locked position and retracted into the frame into an unlocked position by operation of the motor driven bolt actuator. When an electro-mechanical motor driven actuator is selected, it may be controlled by any electronic or mechanical switch known to the art. For example, a simple dpdt switch may be utilized or an electrical switch operated by means of an electronic processor. A specific switch is selected depending upon, as discussed below, the operation of the actuator selected.

The motor driven bolt actuators may comprise, for example, a simple solenoid axially aligned with the bolt and connected thereto by means of a linkage means such as, for example, a connecting rod. A d.c. motor may also be utilized to operate the bolt. It is also contemplated that a hydraulic, vacuum or compressor operated pneumatic motor may be utilized to operate the bolt.

In a second embodiment of the present invention a high security locking device is disclosed comprising a frame; a coaxial slide bolt having an inner core and an outer sheath; a cylinder assembly positioned within the frame; an outer sheath positioning means coupled to and operated by the cylinder assembly; and a motor driven bolt actuator affixed to a first terminus of the outer sheath and coupled to a first terminus of the inner core by a linkage means. The motor driven bolt actuator does not necessarily have to be affixed to the outer sheath and is, in one embodiment, for example, affixed to a portion of a car door frame. The coaxial bolt includes a first and second terminus wherein the second terminus may be extended outward from the frame into a locking position as discussed below.

In the second embodiment of the present invention, the second terminus of the outer sheath is extended from the frame into a locked position and retracted into the frame into an unlocked position by operation (rotation) of a cylinder within the cylinder assembly and concurrent rotation of the positioning means. The second terminus of the inner core is extended from the frame into a locked position and retracted into the frame into an unlocked position by means of the motor driven bolt actuator independent of the extension or retraction of the outer sheath. However, the extension and retraction of the outer sheath simultaneously extends and retracts the inner core without utilizing the electro-mechanical means due to friction between the inner core and outer sheath.

The motor driven bolt actuators utilized in the second embodiment of the present invention may comprise, for example, a simple solenoid axially aligned with the bolt and connected thereto by means of a linkage means such as, for example, a connecting rod. A d.c. motor may also be utilized to operate the bolt. It is also contemplated that a hydraulic, vacuum or compressor operated pneumatic motor may be utilized to operate the bolt.

In each embodiment of the present invention, it is contemplated that the lock frame is mounted within a vehicle door frame if the door frame provides sufficient space to accommodate the locking device. The lock frame may be affixed to the door frame by any suitable means such as, for example, by means of a nut and bolt assembly, sheet metal screws, rivets, and welding to the door frame. A bolt receiving hole is prepared in the door jam position corresponding to a position of the extended bolt during locking operation. Therefore, the bolt may be extended from within the door frame through the receiving hole prepared in the door jam of a car frame to lock the door. If desired, a bolt receiving plate may be added to the door jam to increase the strength of the receiving hole. The bolt receiving plate may include a sloped portion similar to a bolt guidance portion of a lock striker plate. The sloped portion would be especially useful if the bolt was inadvertently placed in the extended position during closing of a vehicle door. The sloped portion of the receiving plate in that case would force a partially extended bolt back into a retracted position to allow closure of the door without damage to the door or fender.

It is also contemplated that the lock frame may be mounted within the fender or quarter panels of a vehicle. In this mounting configuration, a bolt receiving hole is placed within the door frame itself for providing a locking function. The fixation method for mounting the frame inside a vehicle fender or panel and use of a bolt receiving plate are substantially the same as when a door mounted configuration is utilized.

In both door mounted and fender mounted applications, a face (or front) plate surface of the frame in which a keyed cylinder is positioned is aligned substantially parallel to the outside of the vehicles door, fender or panel.

The second embodiment of the present invention includes a coaxial slide bolt which may optionally include a friction producing means for increasing the resistance of the inner core to sliding within the outer sheath. The friction producing means helps to ensure that retraction or extension of the outer sheath produces a simultaneous extension and retraction of the inner core.

When it is desirable to utilize the friction producing means described above, the outer sheath may include, for example, a section located proximate to the first terminus of the outer sheath which is partially open therefore surrounding only a portion of the first terminus of the inner core. It is then possible to utilize, for example, a coil spring affixed across, so as to traverse, the open portion of the sheath. The spring position allows it to be biased against the core to produce added resistance to sliding of the core within the sheath. The surface of the core in contact with the spring may be scored to increase spring traction.

In the second embodiment of the present invention, it is advantageous to limit the extension of the inner core from the retracted to extended position. Therefore, the inner core includes, for example, a governor pin extending radially from a position adjacent the second terminus of the core. In this example, the outer sheath includes a corresponding longitudinally aligned groove defined by a portion of the outer sheath adjacent to the second terminus. The governor pin is aligned and passes through the sheath groove so that the extension and retraction of the inner core is restricted by the distance the pin may travel within the groove.

The frame in certain embodiments advantageously includes an additional stop to limit core extension. In one example of the second embodiment the device includes a pivoting control lever positioned adjacent the second terminus of the coaxial bolt. The control lever defines a slot parallel to the extension and retraction of the inner core through which the governor pin of the inner core passes. Thus, the control lever groove may be utilized to limit the extension of the core while pivoting of the lever causes the lever groove to engage the pin to mechanically extend and retract the inner core.

The second embodiment of the present invention advantageously includes an outer sheath having, positioned upon its outer surface, a series of longitudinally arranged teeth to form a gear rack. The cylinder device is axially aligned with an outer sheath positioning device such as, for example, a pinion gear matingly adapted and positioned for interdigitation with the sheath rack. Rotational operation of the cylinder provides a corresponding rotation of the pinion gear. Thus, rotation of the pinion gear engages the outer sheath rack to extend and retract the coaxial bolt depending upon direction of cylinder operation.

The second embodiment of the present invention includes a frame having a face plate and rear plate. The face plate advantageously includes, for example, a high-security lock cylinder for operation of the cylinder assembly from outside a vehicle. The second embodiment optionally includes a latch device extending axially from the rear plate for operation of the sheath positioning device from within a vehicle.

DETAILED DESCRIPTION OF THE PREFERRED EMBODIMENT

Figure 1A:
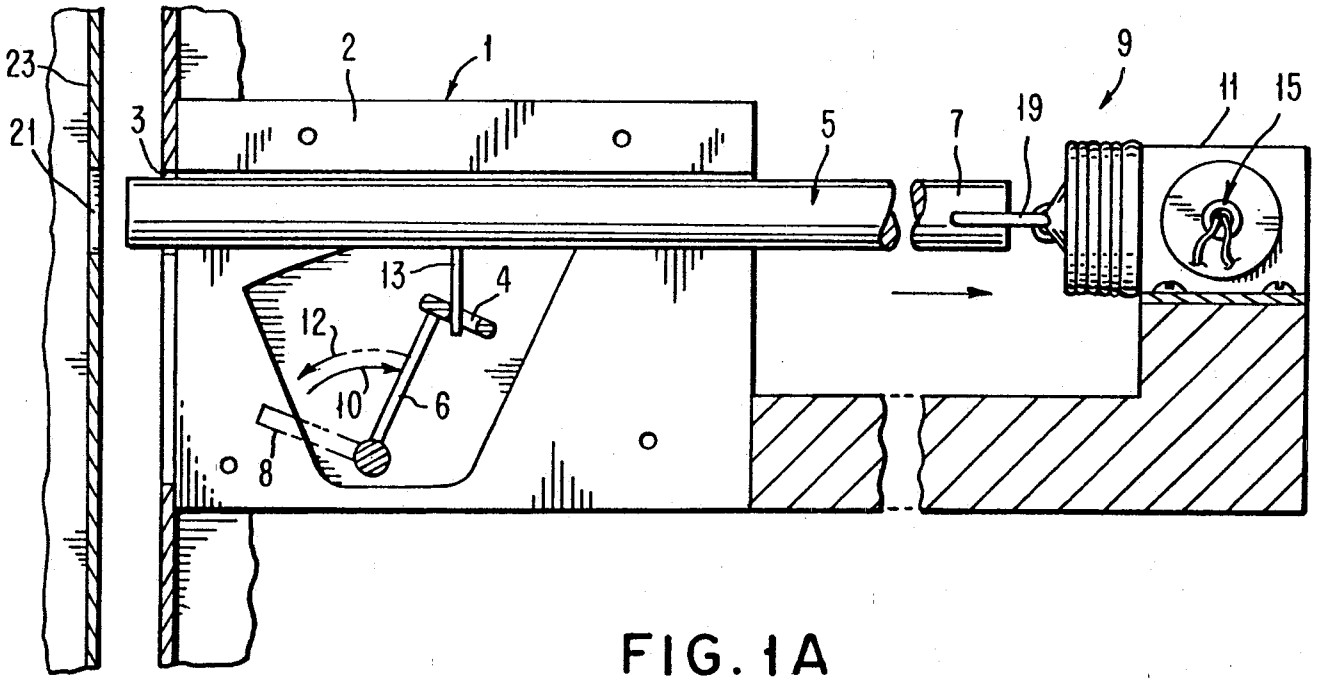
FIG. 1A is a side sectional view of a device in accordance with the first embodiment of the present invention wherein the bolt is extended.
Figure 2A:
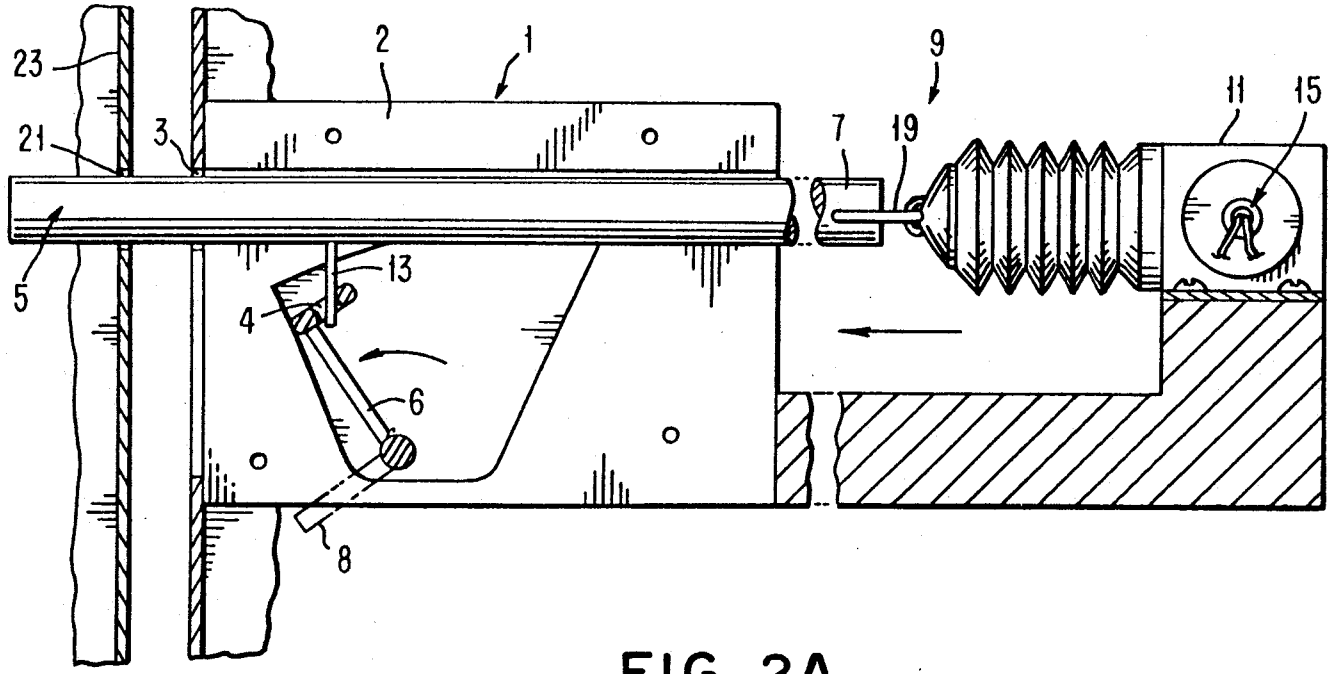
FIG. 2A is a side sectional view of a device in accordance with the first embodiment of the present invention wherein the bolt is retracted.

FIGS. 1A and 2A are side sectional views of one example of the first embodiment of the present invention. The lock frame 1 includes a face plate 2 and a rear plate 44. The frame defines a bore 3 through which bolt 5 is slideably positioned. Linkage means 9 provides a mechanical coupling of a first terminus 7 of bolt 5 with motor driven bolt actuator 11. Suitable motor driven actuators include, for example, d.c. motors and electric solenoids as well as vacuum, hydraulic and compressed air motors. However, it is preferred to utilize a motor of an electro-mechanical design.

FIGS. 1A and 2A illustrate a mechanical override feature. Override pin 13 extends from bolt and engages a corresponding slot 4 defined by pivoting control arm 6. In the event of an electrical failure, bolt 5 may be extended from the lock frame into a locked position by rotating control lever 8 in the direction of arrow 12. Rotation of control lever 8 in the direction of arrow 10 will withdraw bolt 5 to unlock the device.

The electro-mechanical means is connected by means of cable 15 with a suitable source of electrical current. A suitable switch is utilized to control the flow of electrical current to the electro-mechanical means.

When for example, the electro-mechanical device utilized in the present invention includes a biasing spring for returning an internal drive to a first position (e.g. retracted position), the cable and switch are utilized only to supply a current to a single set of motor electrical terminals to produce movement of an internal motor drive in one direction. Energizing these terminals will cause the electro-mechanical device to move the internal drive to a second position (e.g. extended position). In this example, the electrical cable may include only two conducting wires and the electrical switch may be of, for example, a simple single pole design.

When the present device utilizes an electro-mechanical device which requires current for movement of the internal drive to both a first and second position, the switching means and cable must be able to switch electrical polarity. Thus the electrical cable will, in most cases include at least 2 conducting wires and the electrical switch must be capable of directing the flow of current selectively through these wires. A double pole double throw momentary switch, for example, may be utilized for this purpose.

Figure 1B:
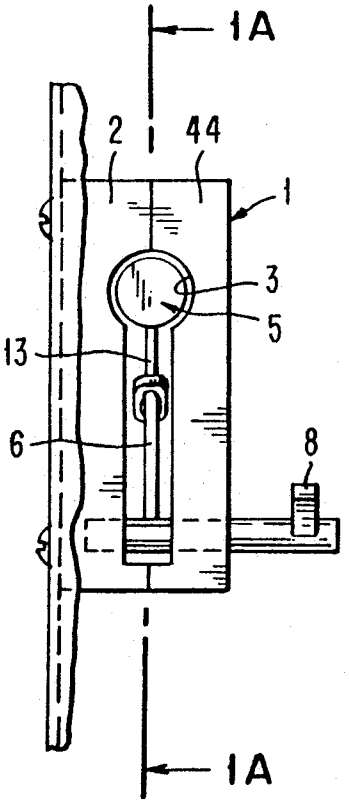
FIG. 1B is a front view of FIG. 1A.
Figure 2B:
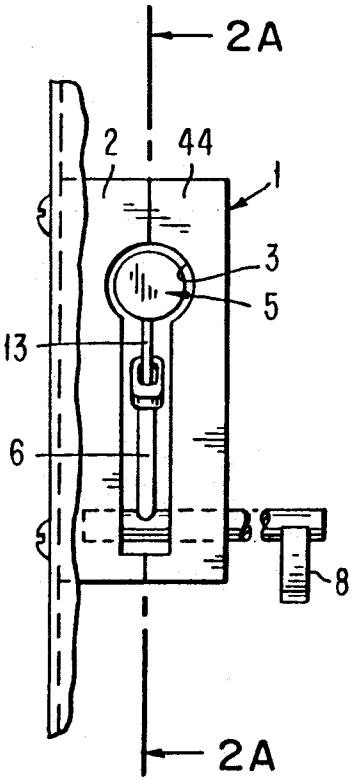
FIG. 2B is a front view of FIG. 2A.

FIGS. 1A and 1B illustrate the locking device of the first embodiment of the present invention in an unlocked position. In FIGS. 2A and 2B, electrical current is applied to electro-mechanical means 11 so as to cause an internal drive of this means to extend towards bolt 5. The movement of the internal drive is transferred to bolt 5 by means of linkage means 19 thereby forcing the bolt to extend from the frame 1 and through receiving hole 21 of car frame 23 into an extended and locked position.

Figure 3A:
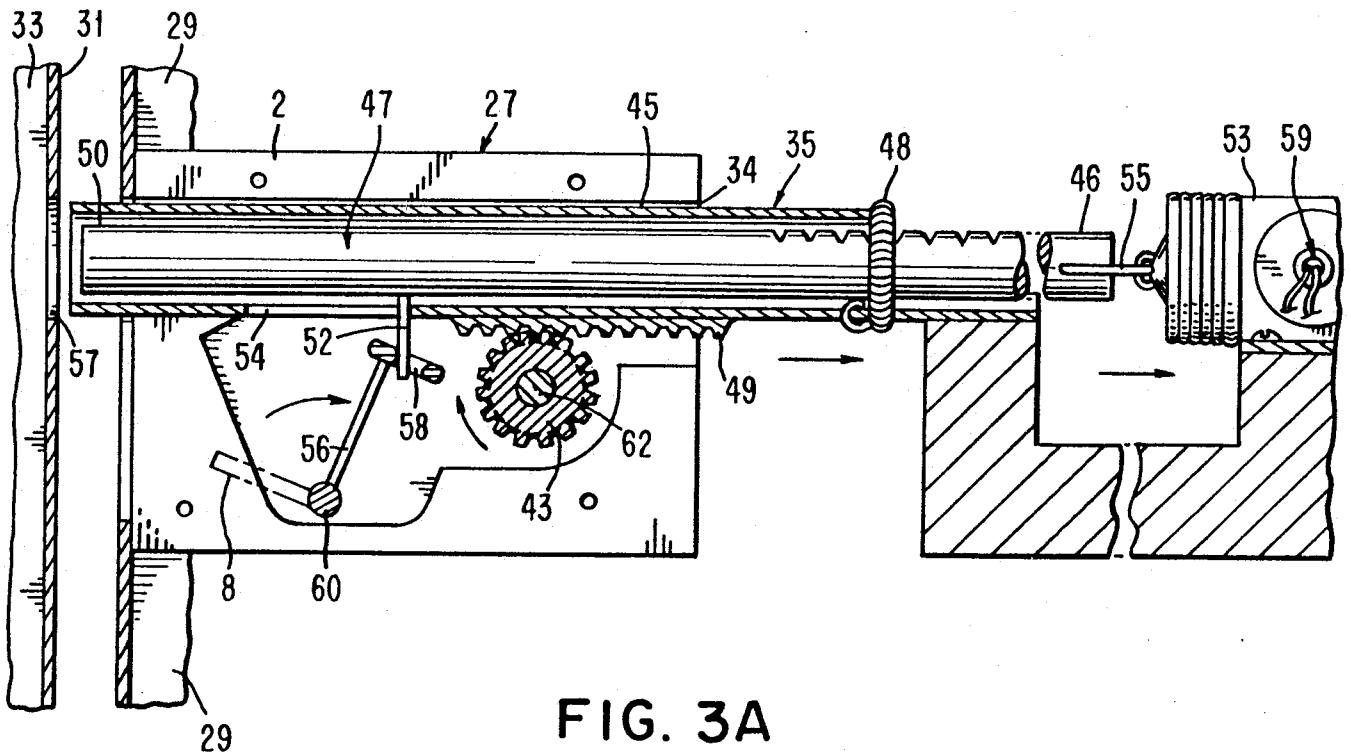
FIG. 3A illustrates a side sectional view of the second embodiment of the present invention.
Figure 3B:
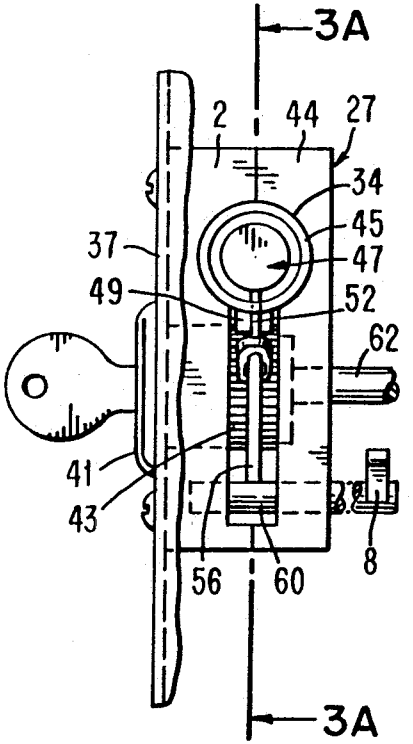
FIG. 3B is a front view of FIG. 3A.

FIGS. 3A and 3B illustrate a side sectional view of the second embodiment of the present invention. In FIG. 3A, lock frame 27 is mounted within vehicle door 29 proximate to door jam 31 of car frame 33. Lock frame 27 defines bolt bore 34 through which coaxial bolt 35 is slideably positioned. Face plate 37 of the lock frame defines a second bore through which keyed cylinder 41 is positioned. The keyed cylinder is axially aligned and coupled to outer sheath positioning means 43 which, in this example of the second embodiment, is a pinion gear.

The coaxial bolt 35 includes an outer sheath 45 and an inner core 47. The outer sheath includes a rack 49 which are matingly adapted and positioned for interdigitation with and operation by pinion gear 43. Proximate to a first terminus 46 of the coaxial bolt, outer sheath 45 is partially open to expose a portion of inner core 47. Affixed to the outer sheath and traversing the open portion is friction producing device 48 (a coil spring in the illustrated example), which is biased against the inner core. The friction producing device assures, as discussed above, that mechanical retraction and extension of the outer sheath produces a simultaneous retraction and extension of the inner core.

FIGS. 3A and 3B illustrate that proximate to the second terminus 50 of the bolt, a governor pin 52 radially extends from the inner core through a corresponding longitudinally aligned governor slot 54 defined by the outer sheath proximate to the second terminus. This arrangement of governor pin and slot assures that the range of extension and retraction of the inner core is confined to the length of the slot. Furthermore, as shown in greater detail in FIG. 3A and 4A, the lock frame includes, in the illustrated example, a pivoting control lever 56 positioned adjacent the second terminus of the coaxial bolt. The pivoting control lever includes a manual latch 60 extending from the rear plate of the lock frame for access and operation of the inner core from within a vehicle. The control lever also defines a slot 58 within which the governor pin of the inner core is positioned thereby limiting core extension to any desired degree of travel by utilizing stops on the control lever to limit its degree of rotation. Operation (rotation) of the control lever is an alternative means utilized to mechanically retract and extend the inner core, especially in the event of an electrical failure. In addition the lock device includes a mechanical latch 62 which is coupled (through rear frame plate 44), with pinion gear 43 for extension and retraction of the outer sheath from within a vehicle.

The inner core 47 is coupled, at a first bolt terminus 46, by means of linkage 55 with electro-mechanical means 53. The electro-mechanical means provides movement of the inner bolt through the outer sheath for extension through (into a locked position) and retraction from (into an unlocked position) receiving hole 57 in receiving surface 31. The electro-mechanical means is supplied with electrical energy through cable 59 which supplies a conduit for the flow of electrical current from electrical current source 17. A switch is provided for control of the flow of electricity through the cable. Any suitable source of electrical current may be utilized for supply power for the electro-mechanical device. The electro-mechanical devices, switches and cable utilized in the second embodiment of the present invention are the same as those discussed above in relation to the first embodiment.

Figure 4A:
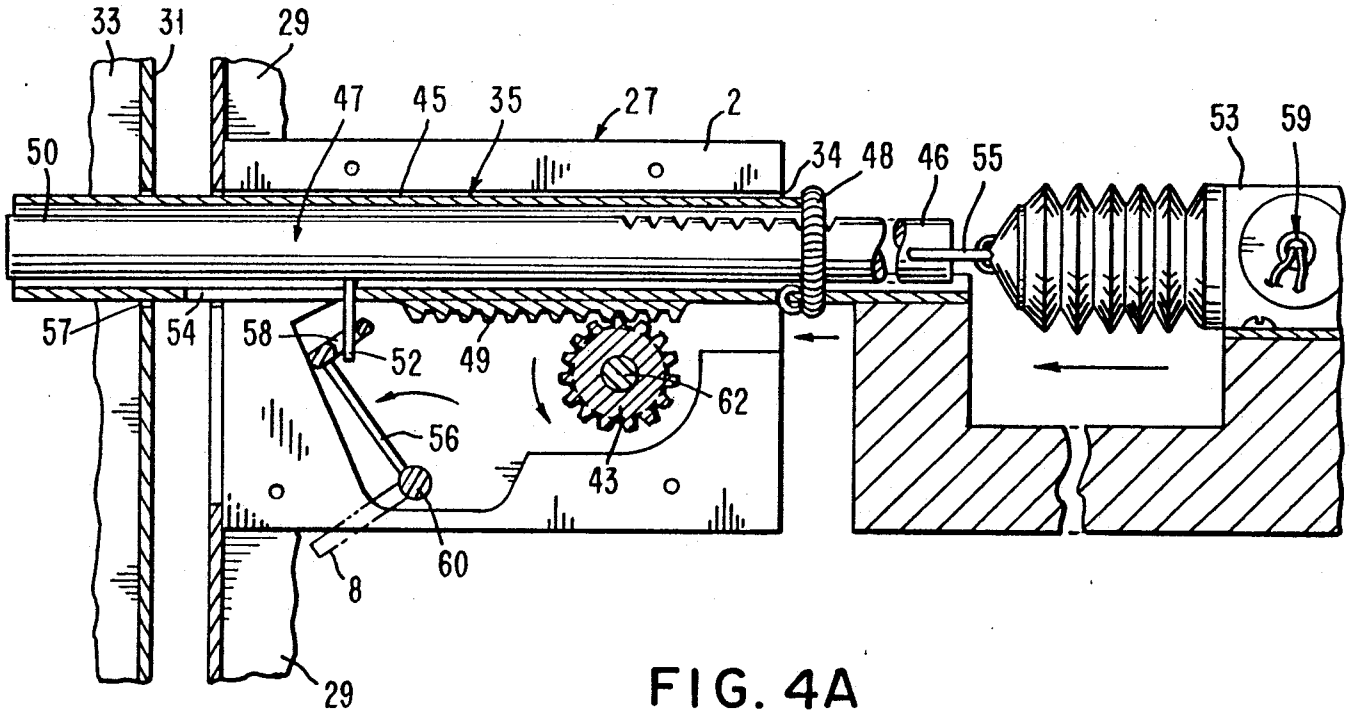
FIG. 4A is a side sectional view of the device of the second embodiment of the present invention wherein the coaxial bolt is in an extended position.
Figure 4B:
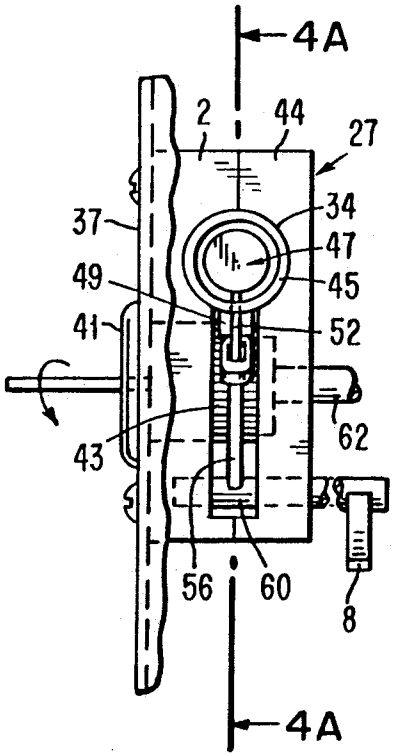
FIG. 4B is a front view of FIG. 4A.
Figure 4C:
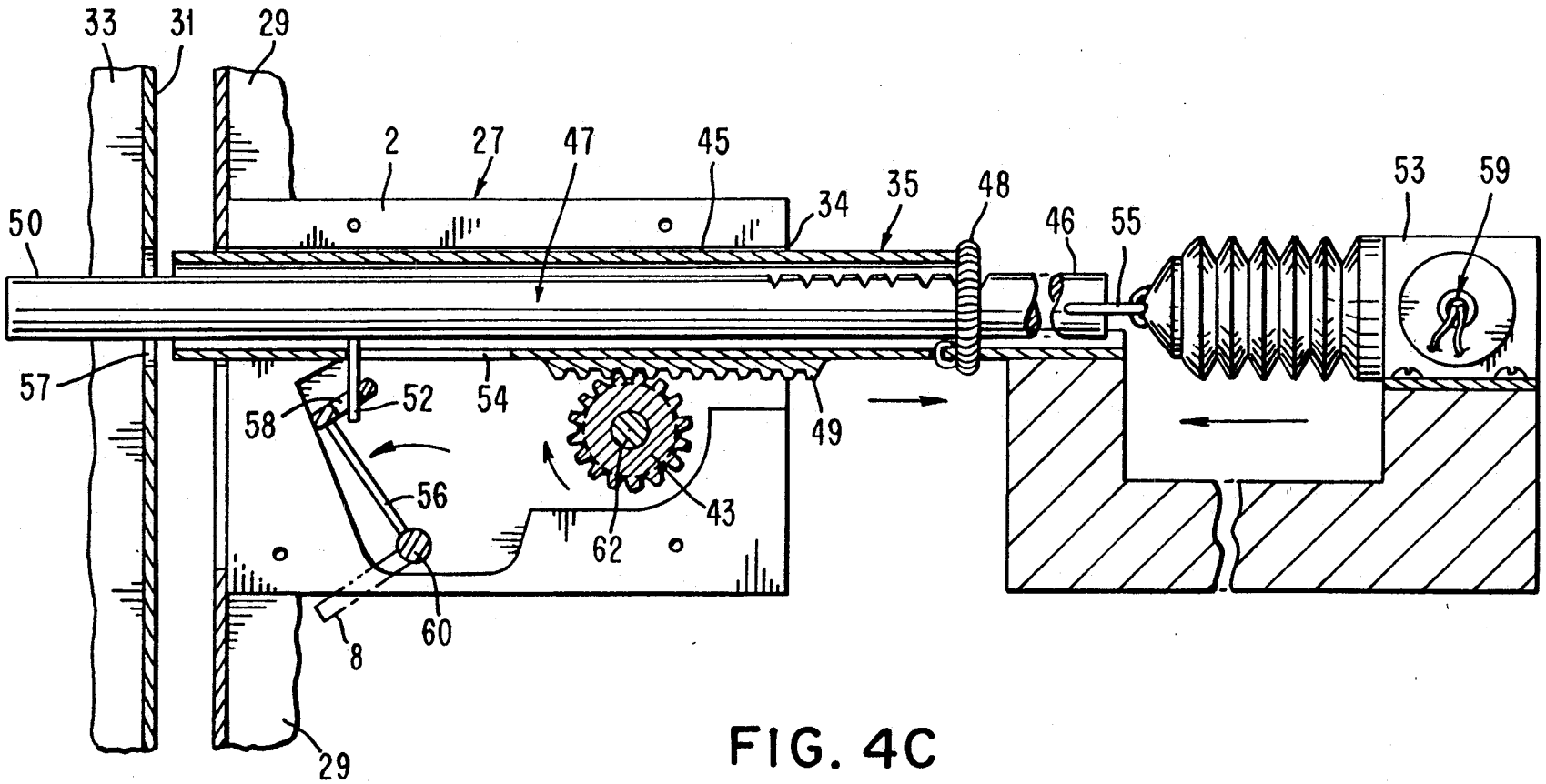
FIG. 4C is a side sectional view of the device of FIG. 4A wherein the inner core alone is extended.

The coaxial bolt of the present invention may be extended into a locked position utilizing the inner core only (as illustrated in FIG. 4C), or by extending both the inner core and the outer sheath (as illustrated in FIG. 4A). Inserting a key into cylinder 41 and rotation thereof will cause the pinion gear 43 to engage the rack 49 of the outer sheath for extension and retraction of the coaxial bolt (including the inner core) through the receiving hole 57. As discussed above, a mechanical latch 58 extending from the rear frame plate 44 is optionally provided to accomplish rack and pinion operation of the coaxial bolt from within a vehicle.

As discussed above, the inner core will extend and retract in a corresponding manner with the outer sheath; a friction increasing, such as a spring, for example, will further assure such operation. However, operation of the electro-mechanical device also allows the inner core to independently extend through the receiving hole into a locked position or be withdrawn into an unlocked position as a locked cylinder assembly locks the outer sheath into either a fully extended or retracted position. As discussed above, the inner core may also be withdrawn from the extended locked position by means of the pivoting control lever so that an electrical failure will not result in an occupant being locked within a vehicle.

Both the first and second embodiments of the present invention utilize a bolt, as opposed to latch design. Therefore, the present invention discloses a vehicle lock which can not be operated by means of a slim-jim device. Furthermore, each of the disclosed embodiments may be operated in conjunction within coded processors and other alarm devices so that remote operation of the bolt and connection thereof with an audible alarm system is possible. In the second embodiment of the present invention, the electro-mechanical operation allows instant security for a vehicle occupant and protection from unauthorized entry. Coupled with this high speed electrical operation, the disclosed invention also provides the safety of mechanical latching minimizing the chances that lock failure would trap a vehicle occupant.

It is preferred that the frame and bolt utilized in the present invention be comprised of a suitably tough aluminum alloy or steel. However, it is also possible to utilize various high strength plastics well known to the art. The keyed cylinder can by selected from those cylinders well known to the art. However, for added security, a high security, pick-resistant cylinder is preferred. For further security, the coaxial sheath operating latch may be of a removable variety including a key-way design so that, upon leaving a vehicle, the inner latch is removed. Thus, even in the event a vehicle window is shattered, the vehicle door still may not be opened.

The lock frame may be, as discussed above, welded, bolted, riveted or affixed by sheet metal screws within a door frame, quarter panel or fender. Installation of the device requires preparation of the bolt receiving hole discussed above as well as aligned openings on the outside surface of a vehicle for the keyed cylinder and on the inside surface for the pivoting control lever and latch. Those skilled in the art of auto body mechanics and vehicle security installations are well aware to the techniques utilized to accomplish such openings and provide for proper alignment thereof.

While it is apparent that the invention herein disclosed is well calculated to fulfill the objects above stated, it will be appreciated that numerous embodiments and modification may be devised by those skilled in the art, and it is intended that the appended claims cover all such modification and embodiments as fall within the true spirit and scope of the present invention.

I claim:

1. A high security locking device comprising:

a frame;

a coaxial slide bolt having a first and second terminus, said bolt including an outer sheath and an inner core slideably positioned within a bore defined by the frame;

a keyed cylinder assembly positioned within said frame;

an outer sheath positioning means affixed to and operated by said cylinder assembly; and a motor driven bolt actuator coupled to a first terminus of the inner core; wherein a second terminus of the outer sheath is extended from the frame into a locked position and retracted into the frame into an unlocked position by operation of the cylinder assembly and positioning means and the second terminus of the inner core is extended from the frame into a locked position and retracted into the frame into an unlocked position by activation of the motor driven bolt actuator thereby providing independent extension and retraction of the inner core without causing a corresponding extension or retraction of said outer sheath and wherein the extension and retraction of the outer sheath provided by operation of the cylinder assembly also simultaneously extends and retracts said inner core without, utilizing said motor driven bolt actuator.

2. The high security locking device of claim 1 where the coaxial slide bolt additionally includes a friction producing means for increasing the resistance of the inner core to sliding within the outer sheath so as to further assure that retraction or extension of the outer sheath produces a simultaneous extension and retraction of the inner core thereby enabling an inner core which has been extended by the motor driven bolt actuator to be withdrawn into said frame by an extension of the outer sheath over said extended inner core followed thereafter by withdrawal of said outer sheath by operation of the cylinder assembly.

3. The high security locking device of claim 2 wherein the outer sheath includes a section which partially open, the section surrounding only a portion of the first terminus of the inner core.

4. The high security locking device of claim 3 wherein the outer sheath completely surrounds the inner core.

5. The high security locking device of claim 3 wherein the friction producing device is a coil spring affixed to the sheath, said spring traversing the open portion of the sheath and the spring being biased against said core to produce resistance to sliding of said core within said sheath.

6. The high security locking device of claim 1 wherein the inner core includes a governor pin extending radially therefrom and said outer sheath defines a grooved portion therein substantially aligned with a longitudinal path defined by the pin during movement of the inner core within the outer sheath wherein said governor pin is aligned with said groove so that the extension and retraction of the inner core is restricted by the distance the pin may travel within said groove.

7. The high security locking device of claim 6 wherein said device additionally includes a pivoting control lever positioned adjacent the second terminus of the coaxial bolt, said control lever defining a slot within which the governor pin of said inner core is positioned wherein said control lever is utilized to limit the extension and to mechanically retract and extend the inner core.

8. The high security locking device of claim 1 wherein said outer sheath includes a longitudinally arranged series of teeth defining a rack matingly adapted for interdigitation with a pinion gear.

9. The high security locking device of claim 8 wherein said outer sheath positioning means is comprised of a pinion gear axially aligned and affixed to said cylinder assembly wherein said pinion is rotated by operation of said cylinder to engage said rack for extension and retraction of the coaxial bolt.

10. The high security locking device of claim 2 wherein said frame includes an inner and outer face plate and wherein said outer face plate includes a key way for operation of said cylinder assembly.

11. The high security locking device of claim 10 wherein said inner face plate includes a latch device for operation of said coaxial bolt without utilizing said cylinder assembly or electro-mechanical actuator.

12. The high security locking device of claim 1 wherein the motor driven bolt actuator is a hydraulic, vacuum, pneumatic or electro-mechanical motor.

13. The high security locking device of claim 12 wherein the electro-mechanical motor is an electric solenoid or reversible d.c. motor.

14. The high security locking device of claim 13 wherein the device includes a mechanical linkage coupling the electro-mechanical motor with the second terminus of the bolt.

15. The high security locking device of claim 14 wherein the electro-mechanical motor is a reversible d.c. motor.

* * * * *